US005314316A

United States Patent [19]

Shibamoto et al.

[11] Patent Number: 5,314,316

[45] Date of Patent: May 24, 1994

[54] SCROLL APPARATUS WITH REDUCED INLET PRESSURE DROP

[75] Inventors: Yoshitaka Shibamoto; Hiroyuki Taniwa; Hiromichi Ueno; Shigeki Hagiwara, all of Osaka, Japan; Ronald J. Forni, Lexington; John E. McCullough, Carlisle, both of Mass.

[73] Assignees: Arthur D. Little, Inc., Cambridge, Mass.; Daikin Industries, Ltd., Osaka, Japan

[21] Appl. No.: 965,150

[22] Filed: Oct. 22, 1992

[51] Int. Cl.[5] ..... F01C 1/02

[52] U.S. Cl. ..... 418/55.1; 418/183; 418/188

[58] Field of Search ..... 418/55.1, 183, 188

[56] References Cited

U.S. PATENT DOCUMENTS 5,101,644 4/1992 Crum et al. ..... 418/188

*Primary Examiner*—Richard A. Bertsch
*Assistant Examiner*—Charles G. Freay
*Attorney, Agent, or Firm*—Bernard J. Lacomis

[57] ABSTRACT

A scroll type fluid machinery which is provided with: a first scroll and a second scroll which moves with respect to the first scroll, where the base of the first scroll is provided with suction bores perforating through the base from the rear surface thereof to the front surface, and open at the outer peripheral portion of the front surface of the base, so that fluid released into an internal space of the body casing passes through the suction bores, and into the suction sides of compression volumes formed between spiral members of the scrolls, whereby suction pressure in the compression volumes is maximized and volumetric efficiency is improved.

8 Claims, 4 Drawing Sheets

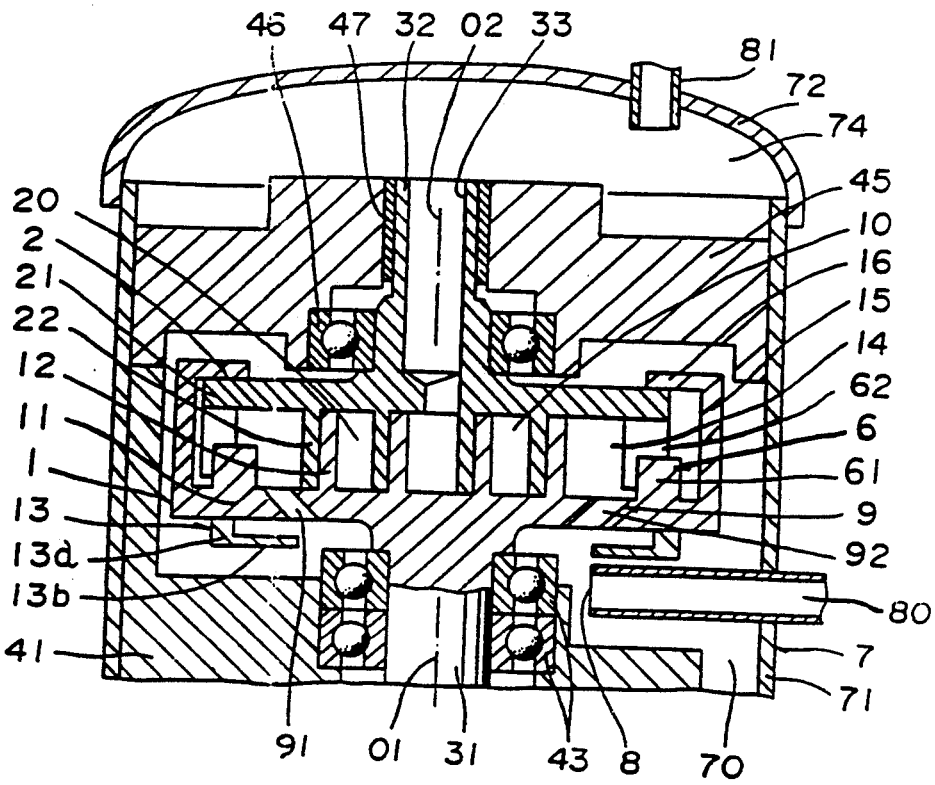
FIG. 5
FIG. 6 PRIOR ART
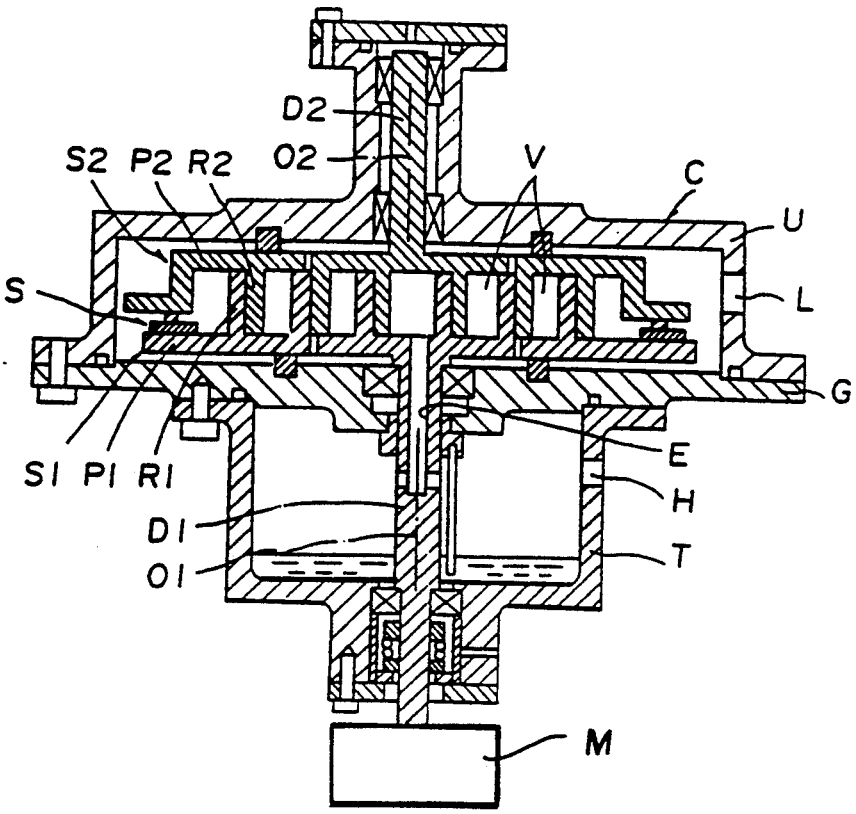

SCROLL APPARATUS WITH REDUCED INLET PRESSURE DROP

FIELD OF THE INVENTION

The present invention relates to scroll type fluid machinery in which a pair of scrolls rotate with respect to each other around laterally displaced rotation axes, and more particularly to scroll type fluid machine used, for example, for a refrigerant compressor in a refrigeration system.

BACKGROUND OF THE INVENTION

Scroll type fluid machinery is well-known, an example of which is Japanese Patent Publication Gazette No. (Hei 1-35196, filed on Jul. 24, 1989) as shown in FIG. 6.

The scroll type fluid machine shown in FIG. 6 is provided with a first rotary shaft D1, a second rotary shaft D2 having a second rotation axis 02 eccentric to a first rotation axis 01 of the first rotary shaft D1, a first scroll S1 which is provided with a first base P1 and a spiral member R1 erected at the front surface thereof and is rotatable around the first rotation axis 01, a second scroll S2 which is provided with a second base P2 and a second spiral member R2 erected at the front surface thereof and is rotatable around the second rotation axis 02, a motor M of a drive source for driving the first rotary shaft D1, a synchronous mechanism S comprising an Oldham's ring for synchronizing the rotation of the first scroll S1 with that of the second scroll S2, a body casing or housing C having an internal space in which the first and second scrolls S1 and S2 are located. The housing including an upper housing U and a lower housing G, and an open suction port L which is in fluid communication with the interior of the housing C and allows fluid to pass into the internal space and then flow into a compression pocket or volume V, formed between the first spiral member R1 and the second spiral member R2.

The motor M rotates the first scroll S1, and the second scroll S2 is rotated at the synchronous speed with the first scroll S1 following the rotation thereof. Low pressure fluid flowing through the suction port L into the internal space of the body casing C flows through the outer peripheries of the first spiral member R1 and second spiral member R2 into the compression pocket or volume V and is sequentially compressed as it moves toward the center of the first spiral member R1 and second spiral member R2. High pressure fluid, after compression, flows to the exterior through a discharge port E provided in the first rotary shaft D1. An oil tank T is provided below the body casing C, and a discharge port H is located at the side wall of the oil tank T.

In the above-mentioned scroll type fluid machine, the first and second scrolls S1 and S2 rotate together and the fluid in the internal space of the body housing C is subjected to the centrifugal force generated as a result of the rotations of the first and second scrolls S1 and S2, thereby causing it to flow radially outwardly therefrom. Therefore, the fluid is inhibited by the centrifugal force from entering the compression pocket or volume V and the suction pressure at volume V is relatively lower than the pressure at the suction port L, thereby reducing volumetric efficiency of the machinery.

It is an object of the present invention is to provide a scroll type fluid machine which can facilitate entry of fluid into compression volumes, minimize suction pressure reduction, and improve volumetric efficiency.

It is a further object of this invention to increase the volumetric efficiency of a scroll type fluid machine by utilizing the centrifugal forces generated by the rotation of the scrolls, to increase the pressure of fluid entering into the compression pockets or volumes, thereby improving volumetric efficiency.

SUMMARY OF THE INVENTION

The present invention is characterized in that the scroll type fluid machinery is provided with (a) a first rotary shaft;

(b) a second rotary shaft having a second rotation axis eccentric to a first rotation axis of the first rotary shaft;

(c) a first scroll provided with a first base and a first spiral member erected at the front surface thereof and rotatable around the first rotation axis;

(d) a second scroll provided with a second base and a second spiral member erected at the front surface thereof and rotatable around the second rotation axis;

(e) a drive source for driving at least one of the first rotary shaft and the second rotary shaft;

(f) a means for moving one scroll in relation to the other;

(g) a body housing having an internal space in which the first and second scrolls are located;

(h) an open suction port in fluid communication with the interior of the body housing for allowing the fluid to flow into the internal space;

(i) the first scroll being provided with a suction bore which perforates the first base from the rear through to the front surface, is open at the outer peripheral portion of the front surface, and allows fluid to flow from the internal space of the housing into the compression pocket or volume formed between the first spiral member and the second spiral member on the suction side of the compression volume.

In the ordinary operation of scroll machines, as the scrolls rotate compression volumes or pockets are first formed near the outer periphery of the scrolls. These volumes or pockets are open at the outer peripheral sides of the scrolls during the intake stage of rotation. It is during this intake stage that fluid located in the surrounding space of the scroll assembly is drawn into or fills the pockets through passages formed in the peripheral edges of the scrolls. However, the fluid that is intended to fill the pockets or volumes of the scrolls is subject to the inherent centrifugal forces generated by the movement of the scrolls, which force tends to inhibit fluid entry into the pockets, and thereby causes the fluid to move away from, rather than toward the scrolls. This fluid resistance reduces the amount of fluid entering the volumes or pockets during the intake period, thus reducing the efficiency of the machinery.

In contrast to the prior art machinery, the present invention provides an arrangement in which the fluid that fills the compression volumes or pockets during the intake stage is introduced into the volumes or pockets in a direction that is generally along the lines of the scroll rotation (rather than against or opposite to); thereby reducing the fluid resistance during pocket entry, and thus, increasing the volumetric efficiency. This is generally accomplished by providing a port or opening for fluid to enter the compression volume or pocket of the scroll machine, such that the fluid fills the volumes or pockets by flowing in generally the same direction as the rotation of the scrolls. The opening or port for the fluid entering the compression volume is positioned to maximize the fluid flow into the volume.

The above-mentioned construction is accomplished by providing fluid entry into the body housing through the suction port, then allowing the fluid to pass through the suction bores provided at the first base, thus reaching the suction side or intake stage of the compression volume. The suction bore perforates through the first base from the rear thereof to the front surface and is positioned such that the fluid entering into the compression volume flows in generally in the same direction as the movement of the scrolls, and is thereby less affected by the centrifugal forces acting on the outer peripheries of the first and second scrolls, thereby facilitating the entrance of the fluid. As a result, the suction pressure of the fluid entering the compression volume is optimized and the volumetric efficiency is superior than that of prior art arrangements.

In the above-mentioned construction, it is preferable that each suction bore is open at the rear surface of the first base, positioned radially inwardly with respect to the opening on the suction side of the compression volume, and slanted radially outwardly from the rear surface of the first base toward the front surface thereof. In this case, the radial position of the suction bores positioned at the rear surface of the first base is less than the radial position of the suction bores positioned at the front surface of the same, so that outlet pressure of the fluid discharged from the suction bores is raised higher than inlet pressure of the same flowing into the suction bores, thereby enabling the fluid entering into the compression volume to be maximized.

Also, it is preferable that the suction bores at the outer peripheral portion of the front surface of the first base comprise a first through bore open in the vicinity of the end of the outer periphery of the first spiral member and a second through bore open in the vicinity of 180° with respect to the first through bore. In this case, the fluid discharged from the first and second through bores constituting the suction bores is directly taken into the compression volume, thereby enabling the suction pressure of fluid entering the compression volume to be maximized.

Also, it is preferable that the suction port is open at the rear of the first base in the vicinity of the suction bores. In this case, the fluid released from the suction port into the body casing easily enters the suction bores, thereby enabling the suction pressure of fluid entering into the compression volume to be maximized.

It is also preferable that at the outer peripheral portion of the rear surface of the first base is provided with a guide projecting rearwardly thereof and oriented toward the center of the first base. In this case, the fluid which does not enter the suction bores cannot flow out along the rear surface of the first base and will be guided toward the suction bores. Hence, the fluid can efficiently flow through the suction bores to enable the suction pressure of the fluid entering into the compression volume to be maximized.

Also, it is preferable that at the outer peripheral portion of the base of at least one of the first and second scrolls is provided with a wall for covering the outer peripheries thereof so as to form a closed space with respect to the compression volume that the suction bores are connected to. In this case, the fluid discharged from the suction bores can be prevented from being blown outwardly due to the rotations of the first and second scrolls. Hence, the fluid discharged from the suction bores can efficiently enter the compression volume, thereby enabling the suction pressure of the fluid entering the compression volume to be maximized.

Furthermore, in the wall in the above-mentioned construction, it is preferable to provide a thrust support for receiving the rear surface of the base of the other scroll at the outer end of the projecting wall. In this case, the wall can also be utilized to provide thrust-support for the other scroll and thereby maximize effectiveness of this construction.

The above and further objects and novel features of the invention will more fully appear from the following detailed description when the same is read in connection with the accompanying drawings.

BRIEF DESCRIPTION OF THE DRAWINGS

FIG. 5 is a longitudinal section view of the principal portion of a third embodiment of the same, and FIG. 6 is a longitudinal section view of the conventional scroll type fluid machine.

DETAILED DESCRIPTION OF THE INVENTION

Figure 1:
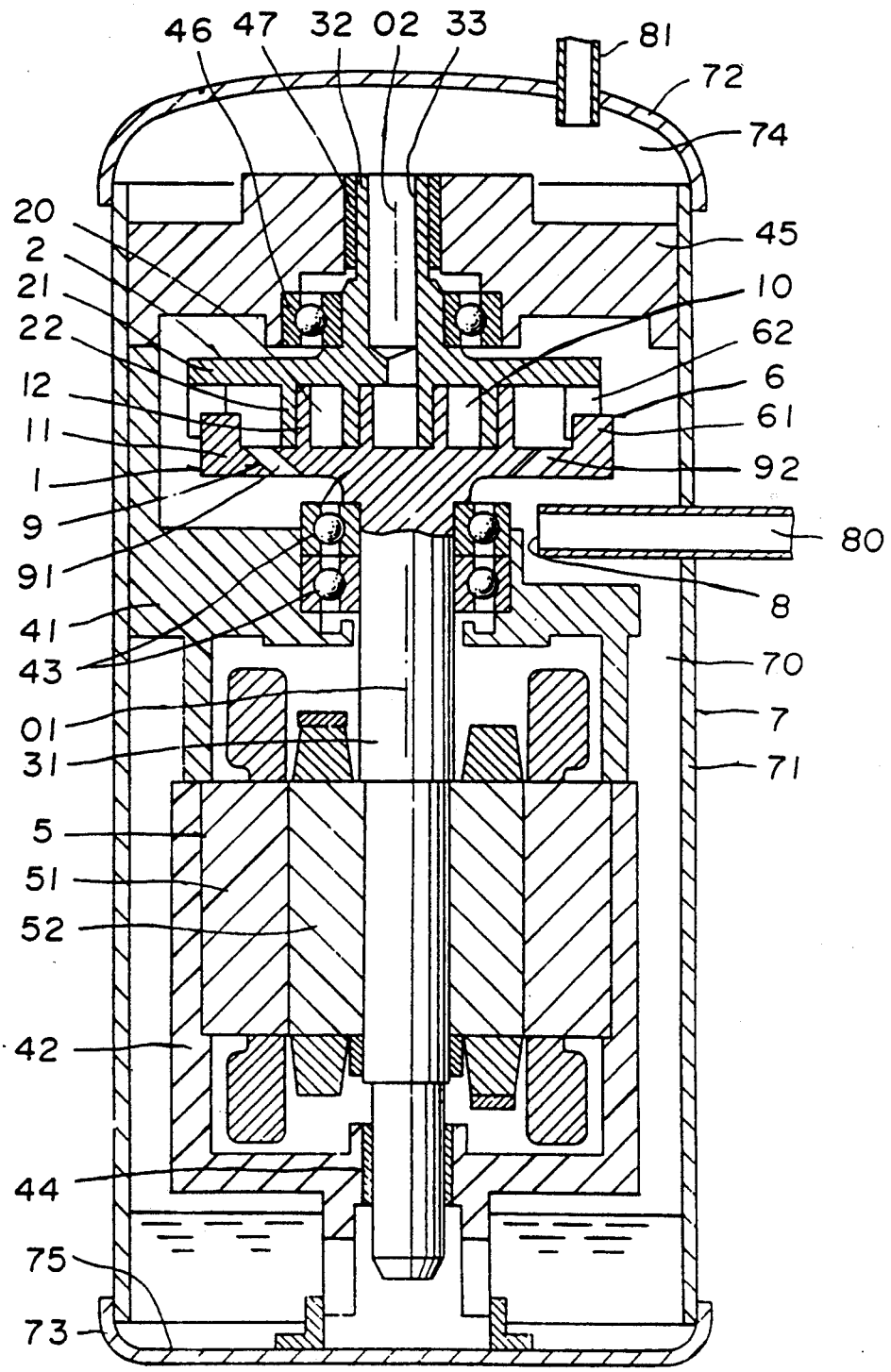
FIG. 1 is a longitudinal section view of a first embodiment of a scroll type fluid machine of the present invention.
Figure 2:
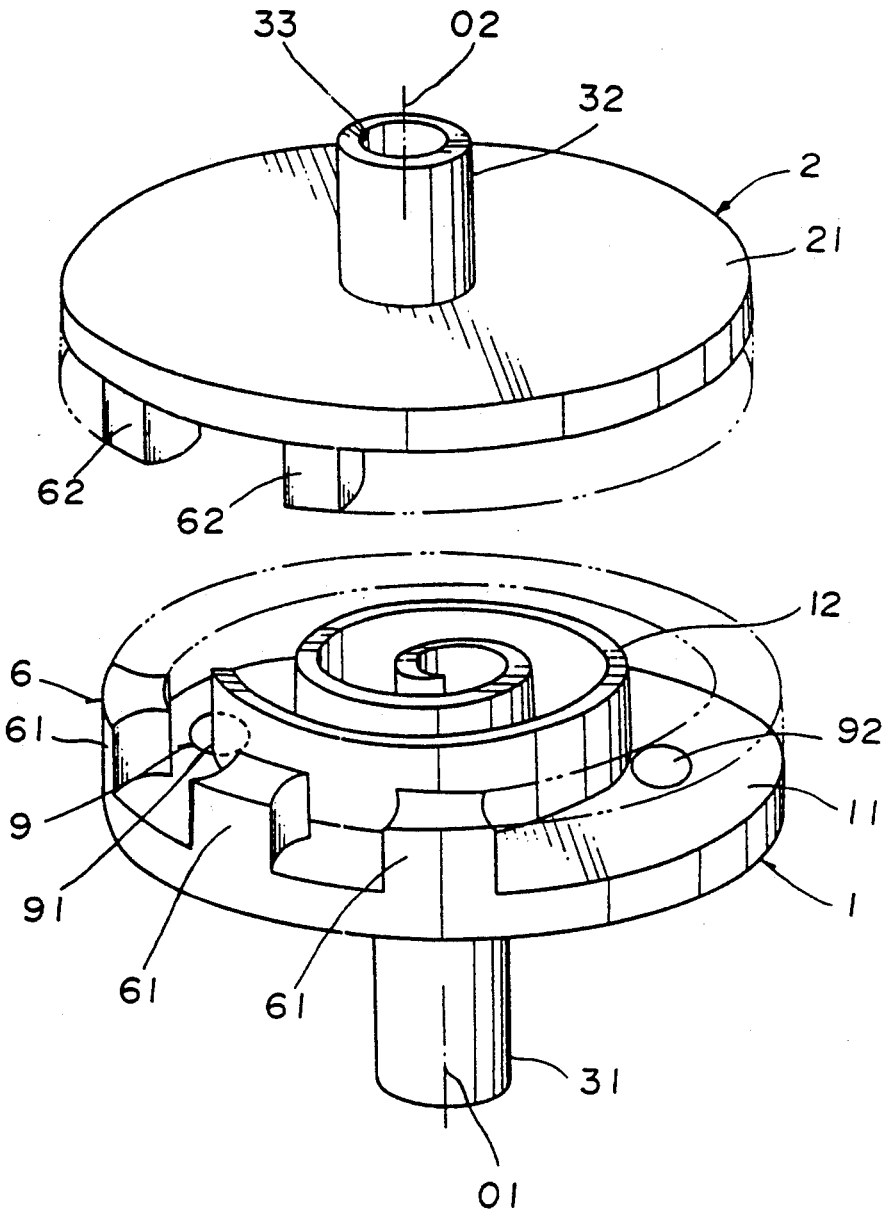
FIG. 2 is a perspective exploded view showing first and second scrolls respectively.

FIG. 1 shows a scroll type fluid machine used as a refrigerant compressor in a refrigeration system. It is detailed below and is provided as the fundamental construction, with a first rotary shaft 31, a second rotary shaft 32, a first scroll 1, a second scroll 2, a motor 5 of a drive source, a synchronous mechanism 6, a body housing 7, a suction pipe 80 having at one axial end an open suction port 8, and a discharge pipe 81 for removing fluid after compression. The scroll fluid machine of the present invention is constructed such that:

(a) the first rotary shaft 31 is rotatably supported to an upper housing 41 and a lower housing 42 through an upper rolling bearing 43 and a lower metal bearing 44, (b) the second rotary shaft 32 has a second rotation axis 02 eccentric to a first rotation axis of the first rotary shaft 31 and is rotatably supported through a rolling bearing 46 and a journal bearing 47 to a partition member 45 fixed to the upper portion of the upper housing 41, (c) the first scroll 1 is provided with a first base 11 integral with the upper axial end of the first rotary shaft 31 and a first spiral member 12 erected upwardly at the front surface of the first base 11 and extending along the involute curve, and rotates around the first rotation axis 01, (d) the second scroll 2 is provided with a second base 21 integral with the lower axial end of the second rotary shaft 32 and a second spiral member 22 erected downwardly at the lower surface of the second base 21 and extending along the involute curve, and rotates around the second rotation axis 02, (e) the motor 5 comprises a stator 51 and a rotor 52, so that the first rotary shaft 31 is directly connected thereto and driven, (f) the synchronous mechanism 6, as shown in FIG. 2, is provided with a plurality of first teeth 61 upwardly projecting from the outer peripheral portion of the upper surface of the first base 11 and a plurality of second teeth 62 downwardly projecting from the outer peripheral portion at the lower surface of the second base 21, so as to synchronize the rotation of the first scroll 1 with that of the second scroll 2, (g) the body housing 7 is provided with a cylindrical body 71 and an upper lid 72 and a lower lid 73 which are fixed to both axial ends of the body 71, houses the first scroll 1, second scroll 2 and motor 5 below the partition member 45 so as to form an internal space 70 in continuation of the outer peripheries of the first and second scrolls 1 and 2, and above the partition member 45 is formed an upper space 74 communicating with the centers of the first and second scrolls 1 and 2 through a discharge bore 33 provided in the second rotary shaft 32, (h) the suction port 8 is open to the internal space 70 of the body housing 7 and fluid introduced into compression volume 10 and 20 formed between the first spiral member 12 and the second spiral member 22 flows from the internal space 70.

In addition, the discharge pipe 81 is open at the upper space 74, and the body housing 7 is provided at the bottom thereof with an oil sump 75 for storing therein lubricating oil.

In the above-mentioned fundamental construction, the first scroll 1 is provided with suction bores 9 which perforate the first base 11 from the rear surface thereof to the front surface and is open at the outer peripheral portion thereof, thus communicating with the internal space 70 in the body housing 7, and with suction side of the compression volumes 10 and 20 respectively.

The openings of the suction bores 9 at the rear surface of the first base 11 are positioned radially inward with respect to the suction sides of compression volumes 10 and 20, the suction bores 9 being radially outwardly slanted from the rear surface to the front surface of the first base 11.

Figure 3:
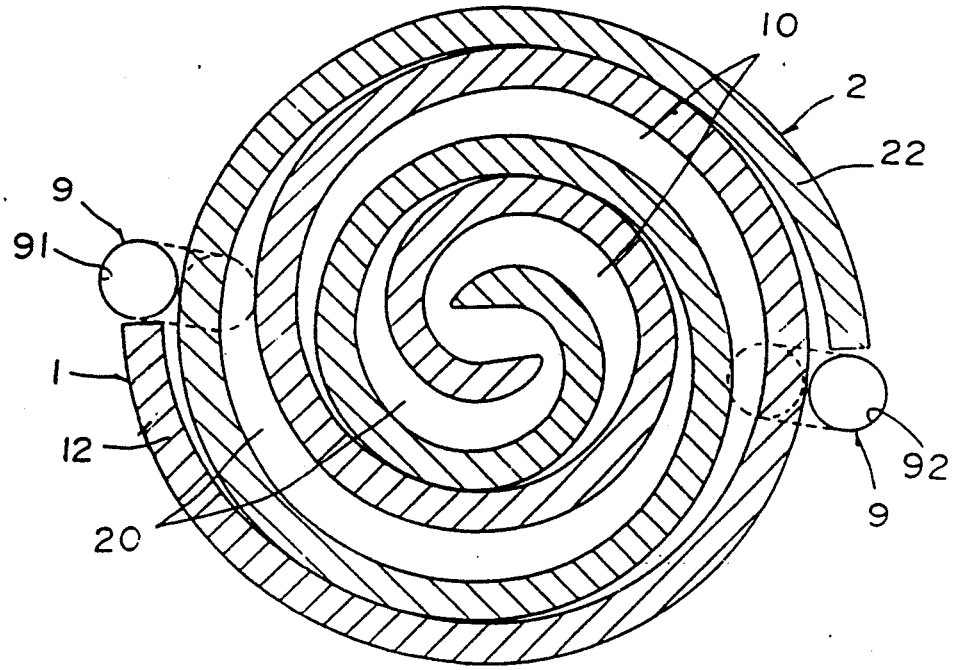
FIG. 3 is a section view showing the configuration where the first and second scrolls engage each other.

Furthermore, the suction bores 9, as clearly shown in FIG. 3, comprise a first through bore 91 open at the outer peripheral portion of the front surface of the first base 11 and in the vicinity of the outer end of the first spiral member 12 and a second through bore 92 open at the outer peripheral portion of the front surface of the same and shifted at an angle of 180° with respect to the first through bore 91.

Also, as shown in FIG. 1, the suction pipe 80 deeply enters into the internal space in the body housing 7, so that the suction port 8 is open at rear of the first base 11 and in the vicinity of the opening of the suction bore 9, that is, the first through bore 91 or the second through bore 92.

Thus, in the above-mentioned construction, the fluid released into the internal space of the body housing 7 through the suction port 8 passes through the first and second through bores 91 and 92 to reach the suction sides of the compression volumes 10 and 20, at which time the first and second through bores 91 and 92 perforate the first base 11 from the rear surface thereof to the front surface, and are open at the front surface of the first base 11 and in an axial range diametrically smaller than the outer diameter of the first scroll 1. Hence, the fluid intended to be introduced into the compression volumes 10 and 20 is less affected by the centrifugal force caused by the rotation of the first and second scrolls 1 and 2 and easily enters the compression volumes 10 and 20. As the result, the suction pressure of fluid entering into the compression volumes 10 and 20 can be maximized and volumetric efficiency can be improved.

Also, in the above-mentioned construction, the first and second through bores 91 and 92 are slanted radially outwardly from the rear surface of the first base 11 to the front surface thereof, whereby a diametrical separation between the opening positions of both the through bores 91 and 92 at the rear surface of the first base 11 is different from that between the through bores 91 and 92 at the front surface of the same, whereby outlet pressure of the fluid discharged from the through bores 91 and 92 can be raised higher than inlet pressure of the fluid flowing into the same. Hence, the suction pressure of fluid entering into the compression volumes 10 and 20 can be maximized.

Furthermore, in the above-mentioned construction, the suction bores 9 comprise the first through bore 91 open at the outer peripheral portion of the front surface of the first base 11 and in the vicinity of the outer end of the first spiral member 12 and the second through bore 92 shifted at an angle of 180° with respect to the first through bore 91, so that the fluid discharged from the first and second through bores 91 and 92 is directly taken into the compression volumes 10 and 20, thereby enabling the suction pressure entering into the compression volumes 10 and 20 to be maximized.

Also, since the suction port 8 is open at the rear of the first base 11 and in the vicinity of the open position of the first through bore 91 or the second through bore 92, the fluid to be released into the body housing 7 from the suction port 8 easily flows into the first and second through bores 91 and 92, whereby the suction pressure of fluid entering into the compression volumes 10 and 20 can be maximized.

Next, an explanation will be given on a second embodiment of the present invention in accordance with FIG. 4.

The second embodiment of the scroll type fluid machine of the present invention is provided with a guide 13 having a cylindrical member **13*a* rearwardly projecting from the outer peripheral portion on the rear surface of the first base 11 at the first scroll 1 and an annular plate-type bottom 13*b* projecting from the outermost end of the projection of the cylindrical member 13*a* toward the center of the first base 11**. Other constructions are the same as those in the first embodiment.

Figure 4:
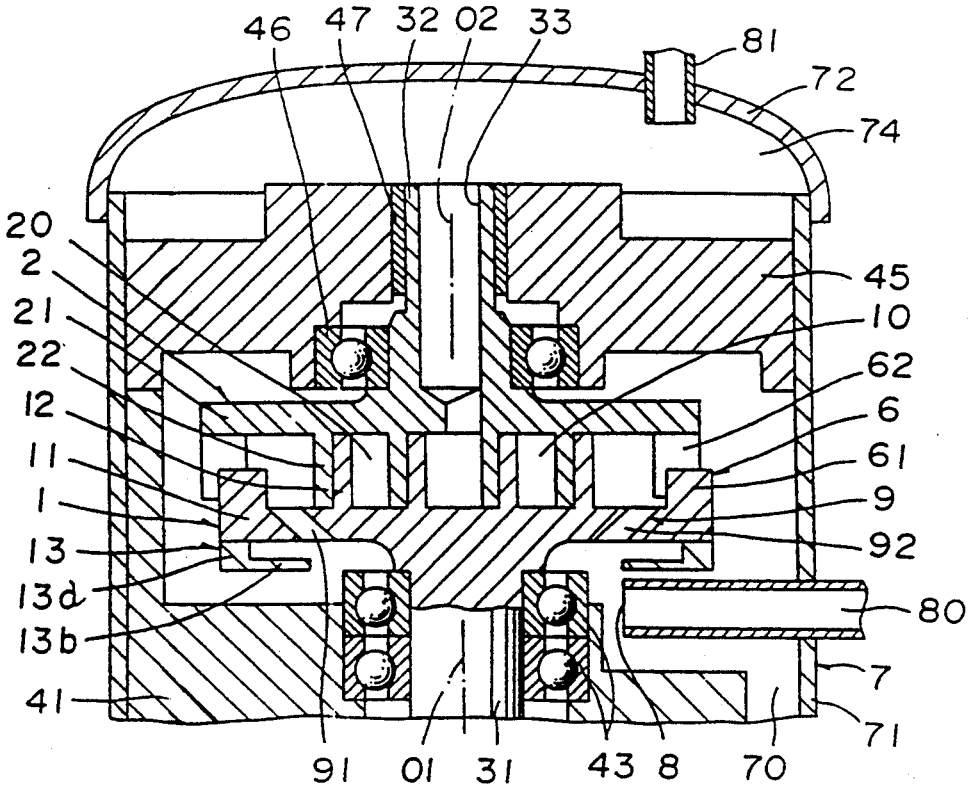
FIG. 4 is a longitudinal section view of the principal portion of a second embodiment of the present invention.

In the second embodiment shown in FIG. 4, any fluid trying to flow outwardly along the rear surface of the first base 11, avoiding the suction bores 9 open at the first base 11 can be checked by the cylindrical member **13*a* constituting the guide 13 and guided into the suction bores 9 along the bottom 13*b*. Hence, the fluid can properly pass through the suction bores 9 to thereby enable the suction pressure of fluid entering into the compression volumes 10 and 20** to be maximized.

Next, explanation will be given on a third embodiment of the present invention in accordance with FIG. 5.

The third embodiment is so constructed that a wall 15 is provided at the outer periphery of the first base 11 of the first scroll 1 for covering the outer peripheries of the first and second spiral members 12 and 22 of the first and second scrolls 1 and 2 respectively, so as to form a limiting space 14 with respect to the internal space 70 of the body housing 7. The wall 15 is constructed such that when fluid flows into the compression volumes through suction bores 91 and 92, it is inhibited or substantially prevented by the wall from leaking or passing through the compression volumes into the internal space adjacent to the first and second spiral members 12 and 22. Therefore, the fluid entering the compression volumes through the suction bores, remains within the compression volumes, thus maximizing the suction pressure of the fluid therein, and increasing the volumetric efficiency.

Furthermore, at the outermost end of the projection from the wall 15 is provided an annular thrust support 16 for receiving the rear surface of the second base 21 of the second scroll 2.

Other constructions of the third embodiment are the same as those of the second embodiment in FIG. 4.

In the third embodiment shown in FIG. 5, the wall 15 can prevent the fluid discharged through the suction bores 9 from being blown outwardly due to the rotation of the first and second scrolls 1 and 2. Therefore, the fluid discharged from the suction bores 9 can properly be taken into the compression volumes 10 and 20 so that the suction pressure of fluid entering therein can be maximized.

Furthermore, since the thrust support 16 is provided at the outermost end of the projection at the wall 15, the wall 15 is utilized to enable the second scroll to be thrust-supported to thereby make most efficient use of the construction.

In addition, although all of the above-mentioned embodiments of the present invention are applied to compressors, they are applicable similarly to vacuum pumps, as well.

Although several embodiments have been described, they are merely exemplary of the invention and not to be constructed as limiting, the invention being defined solely by the appended claims.

What is claimed is:

1. A scroll type fluid machine, comprising:

(a) a first rotary shaft;

(b) a second rotary shaft having a second rotation axis eccentric to a first rotation axis of said first rotary shaft;

(c) a first scroll which is provided with a first base and a first spiral member erected on a front surface of said first base and which is rotatable around said first rotation axis;

(d) a second scroll which is provided with a second base and a second spiral member erected on a front scroll surface of said second base and which is rotatable around said second rotation axis;

(e) means for moving one said scroll with respect to the other scroll;

(f) a body housing having an internal space for housing therein said first scroll and said second scroll;

(g) a suction port open into said internal space in said body casing for allowing fluid into said space, said space being in fluid communication with a compression volume formed between said first spiral member and said second spiral member; and (h) said first scroll being provided with a suction bore perforating through said first base from a rear surface thereof to the front surface, open at an outer peripheral portion of said front surface, allowing fluid communication between said internal space of said body casing and a suction side of said compression volume.

2. A scroll type fluid machine according to claim 1, wherein the opening of said suction bore at the rear surface of said first base is positioned radially inwardly with respect to the suction side of said compression volume, said suction bore being slanted radially outwardly from the rear surface of said first base toward the front surface thereof.

3. A scroll type fluid machine according to claim 1, wherein two suction bores are provided, one said suction bore comprising a first through bore open at the outer peripheral portion of the front surface of said first base and in the vicinity of an outer peripheral end of said first spiral member, and the second through bore open at the position shifted at an angle of 180° with respect to said first through bore.

4. A scroll type fluid machine according to claim 2, wherein two suction bores are provided, one said suction bore comprising a first through bore open at the outer peripheral portion of the front surface of said first base and in the vicinity of an outer peripheral end of said first spiral member, and the second through bore open at the position shifted at an angle of 180° with respect to said first through bore.

5. A scroll type fluid machine according to claim 1, wherein said suction port is open at the rear of said first base.

6. A scroll type fluid machine according to claim 1, wherein said first base is provided at an outer peripheral portion of the rear surface thereof with a guide projecting rearwardly of said first base and orienting at the outermost end of said projection toward the center of said first base.

7. A scroll type fluid machine according to claim 1, further comprising a wall means located at the outer peripheral portion of at least one of said first or second spiral members, for substantially preventing the leakage of fluid from said compression volume.

8. A scroll type fluid machine according to claim 7, wherein at the outermost projecting end of said wall is provided a thrust support for receiving the rear surface of said base at the other scroll.

* * * * *